United States Patent [19]

Shores

[11] Patent Number: 4,592,280

[45] Date of Patent: Jun. 3, 1986

[54] FILTER/SHIELD FOR ELECTRO-EXPLOSIVE DEVICES

[75] Inventor: Marvin W. Shores, Pomona, Calif.

[73] Assignee: General Dynamics, Pomona Division, Pomona, Calif.

[21] Appl. No.: 594,619

[22] Filed: Mar. 29, 1984

[51] Int. Cl.[4] ..... F42B 3/18

[52] U.S. Cl. ..... 102/202.2; 102/202.5; 102/202.14

[58] Field of Search ..... 102/202.2, 202.1, 202.5, 102/202.9, 202.14

[56] References Cited

U.S. PATENT DOCUMENTS

| | | | |
|---|---|---|---|
| 707,626 | 8/1902 | Norres | 102/202.8 |
| 2,276,638 | 3/1942 | Ackermann | 175/30 |
| 2,408,124 | 9/1946 | Rolfes | 102/202.3 |
| 2,408,125 | 9/1946 | Rolfes | 102/202.2 |
| 2,754,757 | 7/1956 | MacLeod | 102/202.8 |
| 2,818,020 | 12/1957 | Burklund | 102/202.1 |
| 2,821,139 | 1/1958 | Apstein et al. | 102/202.2 |
| 2,916,994 | 12/1959 | O'Neill, Jr. | 102/202.2 |
| 2,987,997 | 6/1961 | Ireland, Jr. | 102/202.3 |
| 2,991,715 | 7/1961 | Slough | 102/202.2 |
| 3,351,012 | 11/1967 | Wilson | 102/202.2 |
| 3,370,140 | 2/1968 | Betts | 102/202.2 |
| 3,572,247 | 3/1971 | Warshall | 102/202.2 |
| 3,638,071 | 1/1972 | Altonen, Jr. et al. | 102/202.3 |
| 3,640,224 | 2/1972 | Petrick et al. | 102/202.2 |
| 3,756,154 | 9/1973 | Snyder | 102/202.2 |
| 3,793,954 | 2/1974 | Johnston | 102/202.2 |
| 3,804,018 | 4/1974 | Janoski | 102/202.1 |
| 4,220,088 | 9/1980 | Kimura et al. | 102/202.7 |
| 4,261,263 | 4/1981 | Coultas et al. | 102/202.8 |
| 4,271,453 | 6/1981 | Yajima et al. | 102/202.2 |
| 4,380,958 | 4/1983 | Betts | 102/202.2 |
| 4,422,381 | 12/1983 | Barrett | 102/202.2 |

*Primary Examiner*—Charles T. Jordan

*Attorney, Agent, or Firm*—Henry M. Bissell; Edward B. Johnson

[57] ABSTRACT

An improved electro-explosive squib device is disclosed with filter/shield characteristics rendering the device substantially immune to electromagnetic environments, thus preventing accidental ignition of the squib device. The invention provides for adapting existing squibs or constructing new squibs with immunity to the electromagnetic environments while adding only a minimal amount of material to the device, thus minimizing the possibility of personnel injury caused by debris ejected from rocket propellant ignited by the squib device. These benefits are achieved while maintaining reliability and extended shelf life, and at minimal cost of conversion or manufacture of the squib devices.

32 Claims, 17 Drawing Figures

FILTER/SHIELD FOR ELECTRO-EXPLOSIVE DEVICES

The Government has rights in this invention pursuant to Contract No. DAAH01-83-C-A280, awarded by the United States Army.

BACKGROUND OF THE INVENTION

1. Field of the Invention

The present invention relates generally to electro-explosive devices such as squibs and, more particularly, to such devices including protective means for preventing accidental ignition of the devices resulting from the presence of the device in an electromagnetic environment.

2. Description of the Prior Art

The electro-explosive device or squib is a fairly common detonator used to ignite an ordnance device such as a rocket, bomb, mine or other explosive charge into which the squib has been placed. The squib typically consists of a casing containing a heat-sensitive explosive material which is ignited by a bridge wire when the bridge wire is electrically heated by application of the electric current to the terminal wires of the squib. The bridge wire and the heat-sensitive explosive material are sealed within the casing in a waterproof manner with a packing material such as plastic, the terminal wires extending through the packing material out of the squib.

In a typical ordnance or explosive application the squib is embedded into a solid rocket propellant or explosive charge, with the terminal wires from the squib leading to a battery and triggering circuit. It is thus apparent that the wires between the squib and the battery triggering circuit may be anywhere from several inches to a number of feet in length.

Use of the squib device in an electromagnetic environment is a common occurrence, given the application of the squib device as a detonator for military ordnance. Such an electromagnetic environment may be caused by electromagnetic energy emanating from radar transmitters, telemetering systems, or high frequency communication equipment. When an electro-explosive device such as a squib with only a few inches of wire extending from the squib is located in such an electromagnetic environment, premature and unintended initiation of squib detonation may occur. Accordingly, protection of such squib devices from detonation due to an electromagnetic environment is essential.

Thus, the first requirement of the present invention is that the squib must be made completely immune from a surrounding electromagnetic environment. Of course, it may also be appreciated that the squib must have excellent reliability characteristics as well as an acceptable extended shelf life for use in a military application. In addition, the cost of providing a squib device with protection against premature detonation in an electromagnetic environment is an important consideration in terms of cost per unit. Since there are literally hundreds of thousands of squibs which have already been constructed, it is also desirable that the present invention be adaptable for use on an existing squib charge to prevent the immediate obsolescence of such existing devices.

Another important design requirement, and one nearly as critical as that of immunity to electromagnetic environments, is that the protected squib device have extremely low mass, particularly those portions of the squib which are metallic. This requirement is a result of the increasing use of squib charges to detonate solid propellent rocket motors used in shoulder-fired anti-armor assault weapons. Such weapons, which are descendants of the bazooka, are typically intended for a single use, after which the weapon is thrown away.

In such a device, the principal safety hazard is that of debris ejected from the device when it is fired. Such debris is principally the remnants of the squib device installed at the rear of the solid propellant used to fire the projectile, these remnants of the squib being discharged from the exhaust end of the weapon at high velocity. Thus, it can be seen that in order to minimize the potential of injury to personnel standing behind the firing position, the mass of the squib, particularly that of metallic portions contained in the squib, should be kept to an absolute minimum.

A further consideration as far as immunity to electromagnetic environments is concerned is that, typically for a military application, there must be a substantial built-in safety factor requiring that actual performance of the device far exceed the worst case condition which may be encountered. For the present application of the electro-explosive device or squib, the military standard typically requires that the maximum current induced in the bridgewire may not exceed 31.6% of the maximum no-fire current rating of the squib. It may therefore be appreciated that the standard imposed is fairly difficult to meet.

While it may be apparent that the subject prior art includes references dating back many years, upon examination it may swiftly be appreciated that these references are inapplicable to the present application. Early efforts in the field were focused mainly at safeguarding against electrostatic discharges, an earlier problem resolved by using coherer action as in U.S. Pat. No. 2,408,125, or by using means for producing a discharge at a location removed from the explosive material such as the discharge teeth taught in U.S. Pat. No. 2,408,125 or the spark gap of U.S. Pat. No. 4,261,263. Such devices are not pertinent to the features and objectives of the present invention.

A second approach is that of using a shunt capacitor as taught in U.S. Pat. Nos. 2,818,020 and 3,793,954. Other types of device include the SCR device of U.S. Pat. No. 3,640,224, which involves a time delay required to fire the squib, and the attenuator plug of U.S. Pat. No. 3,572,247. These approaches also do not deal with the particular novel aspects of the present invention, such as are described below.

Thus, it can be seen that the subject prior art does not include any devices having both the virtue of total immunity to high energy electromagnetic environments and the virtue of low mass to minimize ejected debris. While it would seem that such objectives seem mutually unachievable, it may also be appreciated that without both virtues construction of the type of ordnance contemplated by the present invention would be unachievable. Therefore, it can be seen that a substantial need exists for a squib device having a high immunity to high energy electromagnetic environments, low mass to minimize ejected debris, and good reliability characteristics and an extended shelf life, as well as a minimum cost to keep procurement expenses as low as possible. In addition, it is also desirable that the solution be achievable using existing squib devices to prevent making the hundreds of thousands of such devices existing prematurely obsolete.

SUMMARY OF THE INVENTION

The present invention provides a sufficiently high immunity to high energy electromagnetic environments by utilizing a combination filter and shield installed around the lead wires of the squib device closely adjacent to and extending over the casing of the squib device. The preferred embodiment utilizes two feedthrough filters, one installed on each lead of the squib device. A thin metallic cylinder is installed over the filters and a portion of the casing of the squib device, the cylinder maintaining electrical contact with the conductive outer surface of the feedthrough filters and the casing of the squib device.

Thus, by adding the two feedthrough filters, each having an outer diameter less than 1/8 of an inch, and the cylinder, which is made of very thin metal, the squib device is rendered virtually totally immune to electromagnetic environments. The device in fact is sufficiently immune to meet or exceed the applicable military standards required of a squib device for use in electromagnetic environments. Yet the resulting squib device has minimal additional mass, and presents only a minimum of ejected debris upon ignition of the rocket motor.

While in the preferred embodiment the thin metallic cylinder is soldered to the feedthrough filters and the casing of the squib device, alternative embodiments are presented in which electrical contact may be made with serrated fingers on the metallic cylinder in frictional contact with the squib device without the use of solder to make the electrical connection. In addition, various crimping techniques are described to minimize the amount of solder needed to make the connection between the feedthrough filters and the metallic cylinder.

Two alternative embodiments are illustrated which utilize waveguide techniques to attenuate electromagnetic waves. One of the alternative embodiments is suitable for use with a squib having a plastic or non-conductive casing.

It may be appreciated that these techniques are utilizable to convert existing squib devices for use in high energy electromagnetic environments, and present excellent reliability and extended shelf life characteristics, in addition to a high degree of immunity to electromagnetic environments, low unit cost, and low mass. In addition, fabrication techniques are described which may be utilized to manufacture squib devices employing the teachings of the present invention, even further reducing the mass of the resulting squib device.

Thus, it may be seen that the present invention meets the requirement for a low mass squib device with very high immunity to electromagnetic environments. The present invention accomplishes these previously mutually independent objectives at minimal cost with excellent reliability and the ability to utilize existing squib devices. By utilizing a squib device constructed in accordance with the principles of the present invention, a shoulder-fired rocket assault weapon may be constructed having the desired high immunity to electromagnetic environments while ejecting a minimal amount of debris during use to maintain a low potential of injury to personnel.

BRIEF DESCRIPTION OF THE DRAWING

A better understanding of the present invention may be had from a consideration of the following detailed description, taken in conjunction with the accompanying drawings in which.

DESCRIPTION OF THE PREFERRED EMBODIMENTS

Figure 1:
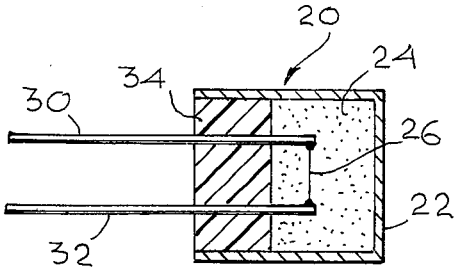
FIG. 1 is a cross-sectional view of a previously-existing squib device.

A commercially available squib device 20 manufactured today in the hundreds of thousands is illustrated in FIG. 1. The squib device 20 includes a metallic casing 22 containing a heat sensitive explosive material 24 therein, the explosive material 24 being typically mercury fulminate, lead azide, or diazo dinitrophenol. The squib device 20 is fired by a bridgewire 26 embedded adjacent the explosive material 24, the bridgewire 26 being connected to a terminal wire 30 at one end, and a second terminal wire 32 at the other end. The terminal wires 30, 32 extend out of the device through a packing material 34, typically plastic, which seals the explosive material 24 in the casing 22. A standard electro-explosive device such as that shown in FIG. 1 is the M-105, which is manufactured by Atlantic Research Corporation, although such devices are commercially available from a number of manufacturers.

Figure 2:
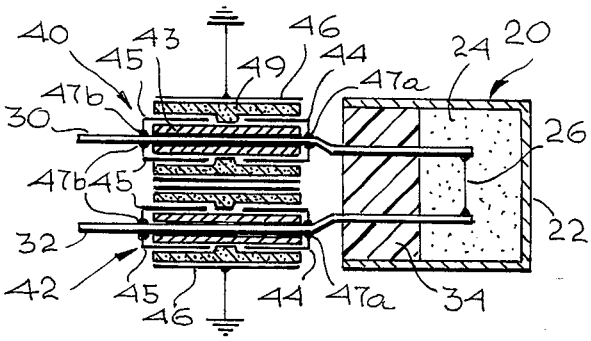
FIG. 2 is a cross-sectional view of the squib device of FIG. 1 having feedthrough filters installed thereon.

An initial approach to make the squib device 20 immune to electromagnetic environments is illustrated in FIG. 2, wherein a pair of feedthrough filters 40, 42 are mounted on the terminal wires 30, 32, respectively, closely adjacent the squib device 20. The feedthrough filters 40, 42 are low pass filters with a rolloff at about 5–6 megahertz. The filters 40, 42 present a flat filtering characteristic above that frequency, thus preventing them from passing electromagnetic energy such as radar energy generally having a frequency range from 0.2–18 gigahertz.

The feedthrough filters 40, 42 illustrated in FIG. 2 are commercially available components such as Erie 1214-010 filters, and have a maximum outer diameter of approximately $\frac{1}{8}$ of an inch and a central bore which will accept the terminal wires 30, 32. The feedthrough filters 40, 42 typically comprise a ferrite segment 43, inner conductor portions 44, 45 which are respectively soldered to the terminal wires 30, 32 at points 47*a*, 47*b* at opposite ends of the filters 40, 42, a ceramic layer 49 and a conductive band 46 surrounding at least a portion of the outer circumference of the filters 40, 42.

In FIG. 2, the conductive bands 46 of the feedthrough filters 40, 42 are shown as being connected to ground, an approach used in the past. Such an approach, unfortunately, allows for coupling of the electromagnet environment in the wire between the filters 40, 42 and the bridgewire 26, which condition could possibly cause firing of the squib 20.

Figure 3:
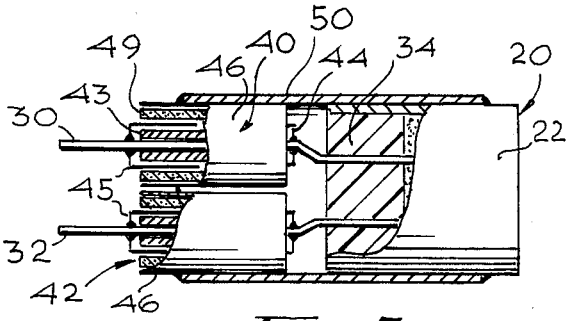
FIG. 3 is a cross-sectional view of the squib device and feedthrough filters of FIG. 2 with a metallic shielding cylinder installed in accordance with the teachings of the present invention.

This situation is prevented when the device is fitted with a cylindrical metallic shield 50, as shown in FIG. 3, which is placed in contact with the conductive bands 46 on the feedthrough filters 40, 42, as well as being in contact with the casing 22 of the squib 20. The feedthrough filters 40, 42 may be attached to the terminal leads 30, 32 by soldering. The cylindrical metallic shield 50 may be soldered to the conductive bands 46 around the inner diameter of the shield 50. To complete the construction, the shield 50 may be attached either by soldering to the casing 22 of the squib 20 or by the use of conductive adhesive.

Figure 4:
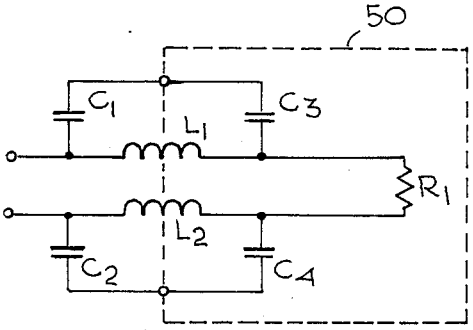
FIG. 4 is a schematic diagram of the equivalent circuit of the device illustrated in FIG. 3.

The device shown in FIG. 3 is electrically modeled in FIG. 4, with capacitors C1 and C3 and the inductor L1 representing the feedthrough filter 40, and the capacitors C2 and C4 and the inductor L2 representing the feedthrough filter 42. The resistance R1 represents the bridgewire 26. The dotted line surrounding the capacitors C3 and C4 and the resistance R1 represents the metallic cylindrical shield 50, which is shown connected between capacitors C1 and C3, the other ends of which are connected to inductor L1, and between capacitors C2 and C4, the other ends of which are connected across inductor L2. One end of each of the inductors L1 and L2 is connected to the resistance R1, and the other ends of the inductors L1 and L2 are the input terminals for the device.

The device illustrated in FIG. 3 is virtually completely protected from electromagnetic environments, and has been found to meet or exceed the military standards described above. It will be appreciated that in order to attain such a level of immunity to electromagnetic environment virtually unparalleled in the past, only a pair of small feedthrough filters 40, 42 and a thin cylindrical shield 50 had to be added to the squib device 20. The addition of these components affords only a slight increase in the hazard resulting from debris ejected during rocket ignition described above. Construction of the device is economical, especially since the feedthrough filters 40, 42 are off-the-shelf items and since existing squib devices 20 may be converted for use in the required environment rather than thrown away. In addition, the device illustrated in FIG. 3 is as reliable as the squib device 20 shown in FIG. 1, even though it is completely safeguarded against an electromagnetic environment.

Figure 6:
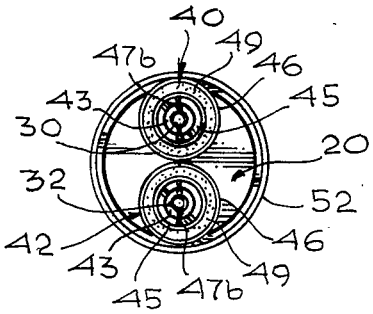
FIG. 6 is an end view of the device shown in FIG. 5.
Figure 5:
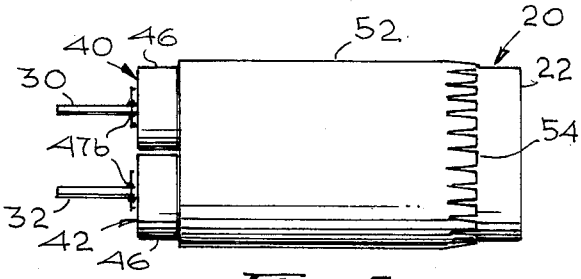
FIG. 5 is a plan view of the present invention similar to that shown in FIG. 3, but utilizing serrated fingers to make electrical contact with the case of the squib device.
Figure 14:
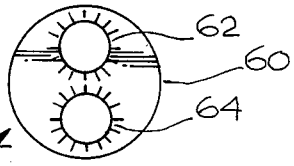
FIG. 14 is an end view of a shield for solderless connection to the feedthrough filters.

Various alternative methods of construction will now be discussed, beginning in FIGS. 5 and 6 in which a shield 52 is illustrated which has a number of serrated fingers 54 affording frictional electrical contact between the shield 52 and the casing 22 of the squib device 20. An alternative suggested by the arrangement illustrated in FIG. 5 is shown in FIG. 14, in which a shielding cup 60 is shown which has a pair of apertures 62, 64 located in the end thereof which are of smaller diameter than that of the conductive bands 46 located on the feedthrough filters 40, 42. A number of radial cuts around the circumference of the apertures 62, 64 are made, and when the shield 60 is inserted over the squib device 20 and the feedthrough filters 40, 42, frictional contact may be made between the shield 60 and the conductive bands 46 on the feedthrough filters 40, 42 without requiring soldering between the shield 60 and the conductive bands 46. By utilizing the construction illustrated in FIGS. 5 and 14, soldering of the shield portion of the device may be completely eliminated.

Figure 8:
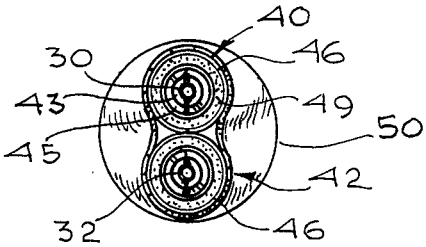
FIG. 8 is an end view of the device of FIG. 7.
Figure 7:
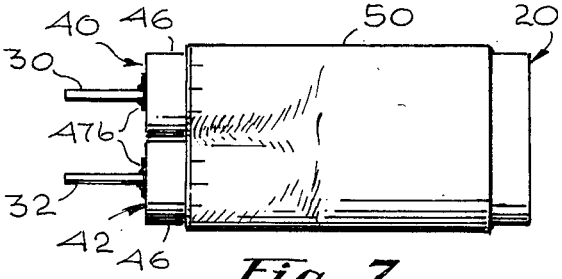
FIG. 7 is a plan view of the device shown in FIG. 3 with the metallic shielding cylinder crimped around the feedthrough filters.

An alternative method to making contact between the shield 50 and the conductive bands 46 on the feedthrough filters 40, 42 is illustrated in FIG. 7, where the portion of the cylindrical shield 50 surrounding the feedthrough filters 40, 42 is crimped around the feedthrough filters 40, 42 as best shown in the end view of FIG. 8. The shield 50 may then be soldered to the conductive bands 46 on the feedthrough filters 40, 42.

Figure 9:
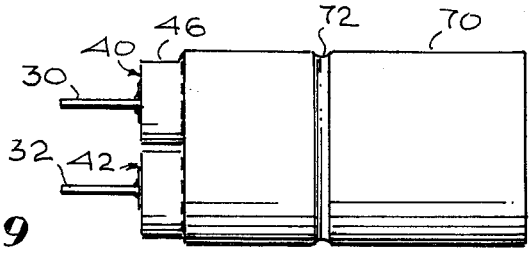
FIG. 9 is a plan view of a device constructed according to the teachings of the present invention utilizing an extended length squib casing.

An alternative construction is illustrated in FIG. 9, where instead of a cylindrical shield construction a cup-shaped shield 70 is illustrated. The cup-shaped shield 70 may be crimped around the end of the squib device 20 as shown at 72 in FIG. 9. FIG. 9 also suggests another technique of construction, whereby the squib 20 has a casing 22 having an extended length which would partially encompass the feedthrough filters 40, 42. Such a technique of construction would involve a redesign of the squib 20.

Figure 10:
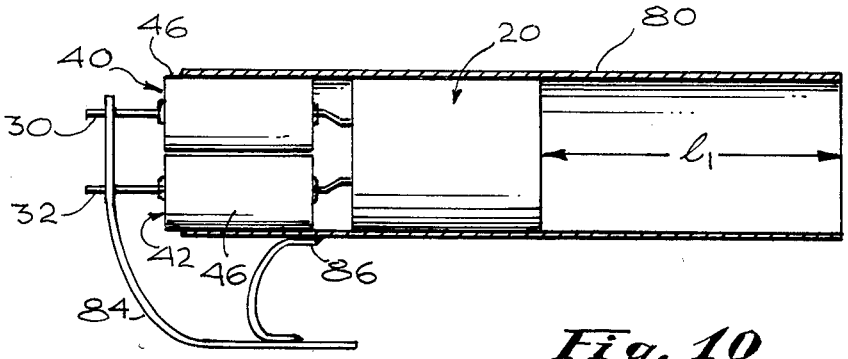
FIG. 10 is a cutaway view of a device constructed according to the teachings of the present invention utilizing a waveguide shield.

FIGS. 10 through 13 illustrate alternative embodiments of the present invention in which the shield portion utilizes waveguide principles, taking advantage of the waveguide-beyond-cutoff effect to protect the bridgewire from currents induced by an electromagnetic environment. In FIG. 10, a thinwall metallic cup 80 is utilized as a shield, the cylindrical portion of the cup 80 extending beyond the end of the squib 20 opposite the terminal wires 30, 32. The critical dimension of the cup 80 is the length $l_1$. The cylindrical portion of the cup 80 extends beyond the end of the squib device 20 by the length $l_1$ which is required to be at least twice the inside diameter of the cup 80. Such a design yields an effective cutoff of frequencies below 55 gigahertz even though the end of the cup 80 is open.

FIG. 10 also illustrates the manner in which the terminal wires 30, 32 may be fastened to a flexible printed circuit harness 84, a portion of which is also connected to the cup 80 at 86.

Figure 11:
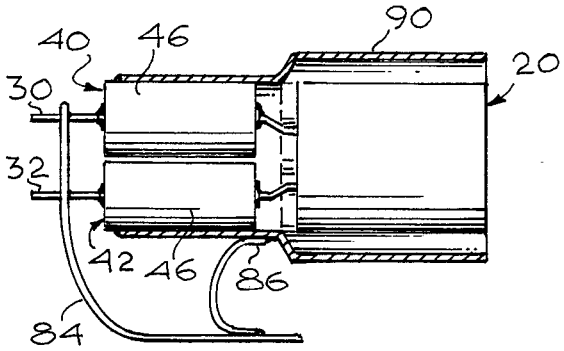
FIG. 11 is a device constructed according to the teachings of the present invention using a short waveguide shield.
Figure 12:
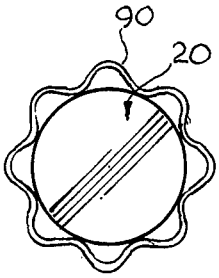
FIG. 12 is an end view of the device of FIG. 11.
Figure 13:
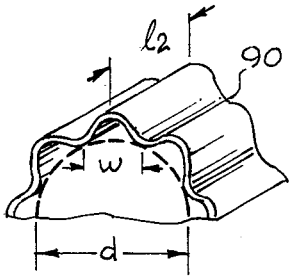
FIG. 13 illustrates the critical dimensions of the device shown in FIGS. 11 and 12.

FIGS. 11 and 12 illustrate another alternative embodiment utilizing waveguide principles in which a thinwall metallic cup 90 is considerably shorter than the cup 80 illustrated in FIG. 10. The portion of the cup 90 surrounding the squib device 20 is corrugated, having eight corrugations around the circumference of the squib device 20. The critical dimensions of the device illustrated in FIGS. 11 and 12 are shown in FIG. 13, where d is the smallest inside diameter of the cup 90, w is the length between the intersection of adjacent corrugations with the diameter d, and $l_2$ is the length of the portion of the cup 90 that is corrugated. It can be seen that w is approximately equal to $\pi d/8$; the requirement of the waveguide device illustrated in FIGS. 11 and 12 is that l must be at least four times w. The device shown in FIGS. 11 and 12 works equally as well as the device shown in FIG. 10 and is substantially smaller and has substantially less mass.

Figure 15:
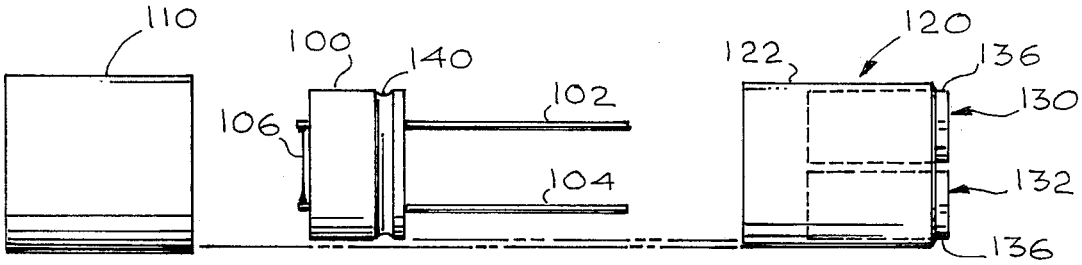
FIG. 15 is an exploded view of a squib device constructed according to the teachings of the present invention.
Figure 17:
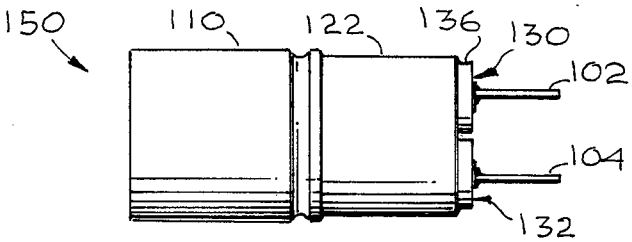
FIG. 17 is a plan view of the device shown in FIGS. 15 and 16.
Figure 16:
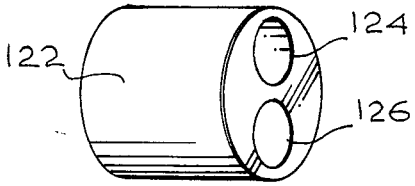
FIG. 16 is a perspective view of the shield portion of the device illustrated in FIG. 15.

For the most part, the above description details how to adapt an existing squib device 20 to achieve the requirements desired. FIGS. 15–17 adapt the teachings of the present invention to the new manufacture of a squib device. As is best shown in FIG. 15, a header 100 containing the two terminal wires 102, 104 and the bridgewire 106 is provided for use between a cup shaped casing 110 containing therein the explosive material (not illustrated), and a filter/shield assembly 120. The filter/shield 120 is constructed of a copper cap 122, best shown in FIG. 16, which has a pair of apertures 124, 126 located in the end thereof. A pair of feedthrough filters 130, 132 are inserted through the apertures 124, 126, respectively, and the conductive bands 136 surrounding a portion of the outer circumference of the feedthrough filters 130, 132 are soldered to the copper cap 122 to complete the filter/shield assembly 120.

The filter/shield assembly 120 is inserted onto the header 100 with the terminal leads 102, 104 extending through the feedthrough filters 130, 132, respectively, where they may be electrically connected by soldering or by using conductive adhesive. The copper cap 122 fits around the circumference of the header 100 and beyond the groove 140 in the header 100. The casing 110 is then placed over the header 100 and the surface of the copper cap 122, and the casing 110 is crimped into the slot 140 surrounding the header 100 to yield the completed squib device 150 illustrated in FIG. 17.

It may thus be appreciated that the present invention provides an improved squib assembly which is substantially immune to electromagnetic environments while utilizing only a minimal amount of material to provide this immunity. Since the additional material has a fairly low mass, the risk of personnel injuries from debris ejected from the exhaust of a rocket ignited by the improved squib device are kept acceptably low. Additionally, the cost of modifying the squib device to provide immunity to electromagnetic environments is quite low, particularly in light of the fact that existing supplies of squib devices may be converted. Finally, although the device provides substantial immunity to electromagnetic environments, the reliability and shelf-life of the squib device are still excellent, resulting in an improved product with excellent performance and cost characteristics.

Although there have been described above specific arrangements of a filter/shield for electro-explosive devices in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A squib for use in an electromagnetic environment, comprising:

a cup-shaped casing;

an explosive charge located in the end of said casing;

a bridgewire located in said casing adjacent said explosive charge;

packing for sealing said bridgewire and said explosive charge in said casing;

a first wire connected to one end of said bridgewire and extending through said packing out of said casing at a first location in said packing;

a second wire connected to the other end of said bridgewire and extending through said packing out of said casing at a second location in said packing spaced away from said first wire;

first means for filtering out currents induced in said first wire by said electromagnetic environment, said first filter means connected to said first wire near said first location;

second means for filtering out currents induced in said second wire by said electromagnetic environment, said second filter means connected to said second wire at said second location; and shield means for preventing said electromagnetic environment from causing currents in said bridgewire or the portion of said first and second wires between said bridgewire and said first and second filter means, respectively, said shield means being electrically connected to said casing and said first and second filter means.

2. A squib as defined in claim 1 wherein said first and second filter means each comprise:

a feedthrough filter of generally cylindrical configuration with a centrally located aperture therethrough, said aperture being lined with a conductive coating and adapted to receive one of said first and second wires therethrough, said filter also having a conductive band around a portion of the outer surface of said filter.

3. A squib as defined in claim 2 wherein said shield means is electrically connected to said first and second filter means by electrical contact with the conductive band of each of said first and second filter means.

4. A squib as defined in claim 2 wherein said first and second filter means are electrically connected respectively to said first and second wires by electrical contact between said wires and the conductive coating within each of the feedthrough filters.

5. A squib as defined in claim 2 wherein said shield means includes in its area of protection at least a portion of the feedthrough filters of said first and second filter means.

6. A squib as defined in claim 2 wherein said feedthrough filter includes a segment of ferrite material.

7. A squib as defined in claim 2 wherein said feedthrough filter has a diameter of approximately ⅛ inch to minimize the amount of debris left when said squib is detonated.

8. A squib as defined in claim 1 wherein said shield means comprises:

a thinwall cylindrical segment of a diameter to accept said squib and said first and second filter means connected to said first and second wires, respectively, said cylindrical segment being electrically conductive and including within the interior volume defined by said cylindrical segment said bridgewire and the portion of said first and second wires between said bridgewire and said first and second filter means as well as a portion of said first and second filter means, said cylindrical segment being in electrical contact with said casing.

9. A squib as defined in claim 8 wherein said cylindrical segment is soldered to said casing to make said electrical contact.

10. A squib as defined in claim 8 wherein said cylindrical segment includes a plurality of integral serrated fingers to make frictional electrical contact with said casing.

11. A squib as defined in claim 8 wherein said cylindrical segment is crimped around the portions of said first and second filter means included within said cylindrical segment.

12. A squib as defined in claim 8 wherein said cylindrical segment has a minimal mass to minimize the amount of debris left when said squib is detonated.

13. A squib as defined in claim 12 wherein said cylindrical segment extends beyond the closed end of said casing by a length at least twice the diameter of said cylindrical segment.

14. A squib as defined in claim 12 wherein the portion of said cylindrical segment overlying said casing is corrugated, having eight corrugations around the perimeter of said portion of said cylindrical segment, the length of said portion of said cylindrical segment being at least $\pi/2$ times the smallest diameter of said portion of said cylindrical segment.

15. A squib as defined in claim 8 wherein one end of said cylindrical segment is closed and has two apertures therein, said apertures being notched to allow for frictional electrical contact with said first and second filter means.

16. A squib as defined in claim 1 wherein said cup-shaped casing is made of a conducting metal and has an extended length to cover the portions of said first and second wires between said bridgewire and said first and second filter means, as well as at least a portion of each of said first and second filter means.

17. A device for enabling the use in an electromagnetic environment of a squib of the type having a bridgewire heatable by supplying an electric current to a pair of wires extending from the squib, the bridgewire being located adjacent an explosive charge in a metallic casing, said device comprising:

a pair of feedthrough filters, each of said filters being mounted on one of said pair of wires at a location closely adjoining said casing; and a metallic shield for protecting the space including said bridgewire and the portions of said pair of wires between said bridgewire and said pair of feedthrough filters, and shield including said space inside it and making electrical contact with said casing and said pair of filters.

18. A device as defined in claim 17 wherein each of said feedthrough filters has a conductive coating on the inner surface thereof defined by the aperture admitting one of said pairs of wires through said feedthrough filter, and a conductive band around a portion of the outer surface of said feedthrough filters, said conductive coating being in electrical contact with the one of said pair of wires extending therethrough, and said conductive band being in electrical contact with said shield.

19. A device as defined in claim 17 wherein said shield is cylindrical and surrounds at least a portion of said casing and at least a portion of each of said pair of filters.

20. A device as defined in claim 19 wherein said shield is crimped around said pair of filters.

21. A device as defined in claim 17 wherein said filters and said shield are of minimal mass to reduce the amount of debris remaining when said squib is exploded.

22. An electro-explosive device protected against premature detonation from currents induced by electromagnetic environments, comprising:

an explosive charge located in a metallic cup-shaped casing;

a bridgewire located in said casing adjacent said explosive charge;

a pair of terminal wires, one of said wires attached to one end of said bridgewire, the other of said wires attached to the other end of said bridgewire, said pair of wires extending out of said casing at the open end thereof;

a first feedthrough filter conductively mounted on one of said wires at the location where the wire extends from said casing, said first filter having a conductive band;

a second feedthrough filter conductively mounted on the other of said wires at the location where the wire extends from said casing, said second filter also having a conductive band; and means for shielding from said electromagnetic environment said bridgewire and the portions of said pair of wires between said bridgewire and said first and second filters.

23. An electro-explosive device as defined in claim 22 wherein said shield means comprises:

a thinwall electrically conductive cylinder including within the space inside the cylinder said bridgewire, the portions of said pair of terminal wires between said bridgewire and said first and second feedthrough filters, and at least a portion of said first and second feedthrough filters.

24. An electro-explosive device as defined in claim 23 wherein said cylinder is in electrical contact with said casing and the conductive bands of said first and second feedthrough filters.

25. An electro-explosive device as defined in claim 24 wherein said cylinder is soldered to said conductive bands of said first and second feedthrough filters at one end of said cylinder, thereby sealing said cylinder at said end.

26. A device for protecting from premature detonation due to presence in an electromagnetic environment an electro-explosive squib of the type using a bridgewire and explosive charge in a casing with deliberate detonation being initiated by application of a current to a pair of terminal wires extending from said casing, said device comprising:

a first feedthrough filter having an aperture therethrough with a conductive coating on the inner surface defined by said aperture and a conductive band extending around a portion of the outer surface of said first filter, said first filter having one of said pair of terminal wires extending through said aperture of said first filter in electrical contact with said conductive coating on said inner surface of said first filter, said first filter being located adjacent said electro-explosive squib;

a second feedthrough filter having an aperture therethrough with a conductive coating on the inner surface defined by said aperture and a conductive band extending around a portion of the outer surface of said second filter, said second filter having the other of said pair of terminal wires extending through said aperture of said second filter in electrical contact with said conductive coating on said inner surface of said second filter, said second filter also being located adjacent said electro-explosive squib; and a metallic shield of generally cylindrical configuration surrounding a portion of and in electrical contact with said casing of said electro-explosive squib, said shield also extending over a portion of said first and second filters and in electrical contact with said conductive bands extending around said first and second filters, said shield including within the space enclosed by the cylindrical shape said brigewire and the portions of said pair of terminal wires located between said bridgewire and said first and second filters.

27. A method of protecting from premature detonation due to presence in an electromagnetic environment an electro-explosive device of the type using a bridgewire and explosive charge in a casing in which detonation is initiated by application of a current to a pair of terminal wires extending from said casing, said method comprising:

mounting a first feedthrough filter having an aperture therethrough onto one of said pair of terminal wires, said one wire being in electrical contact with a conductive coating on the interior of said first filter, said first filter having a conductive band on the exterior of said first filter;

mounting a second feedthrough filter having an aperture therethrough onto the other of said pair of terminal wires, said other wire being in electrical contact with a conductive coating on the interior of said second filter, said second filter also having a conductive band on the exterior of said second filter; and shielding the space including said bridgewire and the portions of said pair of terminal wires between said bridgewire and said first and second filters to prevent the initiation of an electrical current therein caused by said electromagnetic environment.

28. A method as defined in claim 27 wherein said shielding step comprises: p1 installing a metallic, conductive cylinder around at least a portion of said casing and around at least a portion of said first and second feedthrough filters, the space inside said cylinder including said bridgewire and said portions of said pair of terminal wires between said bridgewire and said first and second filters, said cylinder being in electrical contact with said casing and the conductive bands on both of said first and second filters.

29. An electro-explosive device protected against premature detonation from currents induced by electromagnetic environments, comprising:

an explosive charge located in a metallic cup-shaped casing;

a bridgewire located in said casing adjacent said explosive charge;

a pair of terminal wires, one of said wires attached to one end of said bridgewire, the other of said wires attached to the other end of said bridgewire, said pair of wires extending out of said casing at the open end thereof;

a first feedthrough filter conductively mounted on one of said wires where the wire extends from said casing, said first filter having a conductive band;

a second feedthrough filter conductively mounted on the other of said wires where the wire extends from said casing, said second filter also having a conductive band; and waveguide means for attenuating electromagnetic waves to prevent said waves from reaching said bridgewire and the portions of said pair of wires between said bridgewire and said first and second filters.

30. An electro-explosive device as defined in claim 29 wherein said waveguide means comprises:

a thinwall metallic cylindrical segment including in the interior space thereof said casing, said bridgewire, and the portions of said pair of terminal wires between said bridgewire and said first and second feedthrough filters, said cylindrical segment extending beyond the closed end of said casing by a length at least twice the diameter of said cylindrical segment.

31. An electro-explosive device as defined in claim 29 wherein said waveguide means comprises:

a thinwall metallic cylindrical segment including in the interior space thereof at least a portion of said casing, said bridgewire, and the portions of said pair of terminal wires between said bridgewire and said first and second feedthrough filters, the portion of said cylindrical segment overlying said casing being corrugated and having eight corrugations around the perimeter of said portion of said cylindrical segment, the length of said portion of said cylindrical segment being at least $\pi/2$ times the smallest diameter of said portion of said cylindrical segment.

32. A method of manufacturing an electro-explosive device protected against premature detonation caused by currents induced by an electromagnetic environment, comprising:

providing a cylindrical header with a groove located at one end of said header;

inserting a pair of terminal wires through said header in spaced juxtaposition, said terminal wires extending slightly from the other end of said header;

connecting a bridgewire between said terminal wires at the other end of said header;

making a pair of holes in the end of a cup-shaped shield, said holes being of a predetermined aperture size;

connectively mounting a pair of feedthrough filters in said pair of holes in said shield, said feedthrough filters each being generally cylindrical with an aperture therethrough and having a conductive coating on the interior and a conductive band around a portion of the exterior, said conductive bands of said filters being in electrical contact with said shield;

mounting said shield and said filters on said header with one of said pair of terminal wires extending through the aperture in one of said filters in electrical contact with said conductive coating thereof, and the other of said pair of terminal wires extending through said aperture in the other filter in electrical contact with said conductive coating thereof, the open end of said cup-shaped shield extending over said header and beyond said groove in said header;

filling a cup-shaped casing with an explosive charge;

sliding the open end of said cup-shaped casing over said header and said shield on said header to bring said explosive charge into contact with said bridgewire; and crimping said casing and said shield into said groove in said header to fixedly attach said casing and said shield to said header.

* * * * *